US007921927B2

(12) United States Patent
Reilly et al.

(10) Patent No.: US 7,921,927 B2
(45) **Date of Patent: *Apr. 12, 2011**

(54) GASEOUS AND LIQUID AGENT FIRE SUPPRESSION SYSTEM USING EMITTERS WITH CLOSED END CAVITY DEFLECTOR

(75) Inventors: William J. Reilly, Langhorne, PA (US); Robert J. Ballard, Whitehall, PA (US); Kevin J. Blease, Easton, PA (US); Stephen R. Ide, Nazareth, PA (US)

(73) Assignee: Victaulic Company, Easton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/748,984

(22) Filed: Mar. 29, 2010

(65) Prior Publication Data

US 2010/0181081 A1 Jul. 22, 2010

Related U.S. Application Data

(63) Continuation of application No. 11/930,526, filed on Oct. 31, 2007, now Pat. No. 7,686,093.

(60) Provisional application No. 60/864,480, filed on Nov. 6, 2006.

(51) Int. Cl.

| | |
|---|---|
| ***A62C 35/00*** | (2006.01) |
| ***A62C 37/08*** | (2006.01) |
| ***B05B 7/06*** | (2006.01) |
| ***B05B 1/26*** | (2006.01) |

(52) U.S. Cl. ..... 169/16; 169/37; 239/418; 239/424; 239/518

(58) Field of Classification Search ..... 169/14, 169/16, 17, 37, 43–47; 239/67, 200, 207, 239/398, 406–408, 417.5, 418, 424, 424.5, 425, 432–434, 461, 499, 504, 518, 520, 523, 524

See application file for complete search history.

(56) References Cited

U.S. PATENT DOCUMENTS

| | | | |
|---|---|---|---|
| 2,519,619 | A | 8/1950 | Yellott et al. |
| 3,070,313 | A | 12/1962 | Fortman |
| 3,084,874 | A | 4/1963 | Jones et al. |
| 3,108,749 | A | 10/1963 | Drayer et al. |
| 3,117,551 | A | 1/1964 | Fortman et al. |
| 3,157,359 | A | 11/1964 | Fortman |
| 3,297,255 | A | 1/1967 | Fortman |
| 3,326,467 | A | 6/1967 | Fortman |
| 3,371,869 | A | 3/1968 | Hughes |
| 3,638,859 | A | 2/1972 | MacFarlane |
| 3,741,484 | A | 6/1973 | Cresswell |
| 3,779,460 | A | 12/1973 | Monro |
| 3,829,015 | A | 8/1974 | Monro |
| 3,923,248 | A | 12/1975 | Cresswell |
| 3,934,641 | A | 1/1976 | Chielens |
| 4,103,827 | A | 8/1978 | Kumazawa |

(Continued)

FOREIGN PATENT DOCUMENTS

| | | |
|---|---|---|
| EP | 06773057.2 | 4/2009 |

(Continued)

*Primary Examiner* — Darren W Gorman
(74) *Attorney, Agent, or Firm* — Ballard Spahr LLP

(57) ABSTRACT

A fire suppression system includes a gaseous extinguishing agent and a liquid extinguishing agent. At least one emitter is in fluid communication with the liquid and gas. The emitter is used to establish a gas stream, atomize and entrain the liquid into the gas stream and discharge the resulting liquid-gas stream onto the fire. The emitter has a deflector surface with a closed end cavity.

28 Claims, 6 Drawing Sheets

U.S. PATENT DOCUMENTS

| | | | |
|---|---|---|---|
| 4,109,862 | A | 8/1978 | Hughes |
| 4,281,717 | A | 8/1981 | Williams |
| 4,361,285 | A | 11/1982 | Koppehele et al. |
| 4,408,719 | A | 10/1983 | Last |
| 4,531,588 | A | 7/1985 | Brunsicke |
| 4,871,489 | A | 10/1989 | Ketcham |
| 5,248,087 | A | 9/1993 | Dressler |
| 5,297,501 | A | 3/1994 | Lieberman et al. |
| 5,314,117 | A | 5/1994 | Pavliuk et al. |
| 5,405,085 | A | 4/1995 | White |
| 5,495,893 | A | 3/1996 | Roberts et al. |
| 5,687,905 | A | 11/1997 | Tsai |
| 5,829,684 | A | 11/1998 | Fishcer |
| 5,845,846 | A | 12/1998 | Watanabe et al. |
| 5,983,944 | A | 11/1999 | Niv |
| 6,009,869 | A | 1/2000 | Corbeil |
| 6,065,546 | A | 5/2000 | Uetake et al. |
| 6,098,897 | A | 8/2000 | Lockwood |
| 6,173,790 | B1 | 1/2001 | Russwurm et al. |
| 6,261,338 | B1 | 7/2001 | Mahoney et al. |
| 6,311,780 | B1 | 11/2001 | Zuev et al. |
| 6,314,754 | B1 | 11/2001 | Kotliar |
| 6,357,531 | B1 | 3/2002 | Asselin |
| 6,390,203 | B1 | 5/2002 | Borisov et al. |
| 6,401,487 | B1 | 6/2002 | Kotliar |
| 6,418,752 | B2 | 7/2002 | Kotliar |
| 6,502,421 | B2 | 1/2003 | Kotliar |
| 6,557,374 | B2 | 5/2003 | Kotliar |
| 6,560,991 | B1 | 5/2003 | Kotliar |
| 6,662,549 | B2 | 12/2003 | Burns |
| 6,742,721 | B2 | 6/2004 | Piper |
| 6,900,246 | B2 | 5/2005 | List et al. |
| 7,080,793 | B2 | 7/2006 | Borisov et al. |
| 7,111,975 | B2 | 9/2006 | Fenton et al. |
| 7,216,722 | B2 | 5/2007 | Sharma et al. |
| 2004/0188104 | A1 | 9/2004 | Borisov et al. |
| 2004/0195364 | A1 | 10/2004 | Piper |
| 2006/0278410 | A1 | 12/2006 | Reilly et al. |
| 2006/0278736 | A1 | 12/2006 | Reilly et al. |
| 2008/0105442 | A1 | 5/2008 | Reilly et al. |

FOREIGN PATENT DOCUMENTS

| | | |
|---|---|---|
| WO | WO 00/41769 | 7/2000 |
| WO | WO 03/030995 | 4/2003 |
| WO | 2006/023013 | 6/2005 |
| WO | 2006/023013 | 12/2006 |
| WO | 2006/023013 | 2/2007 |
| WO | 2006/023014 | 7/2008 |
| WO | 2007/022873 | 7/2008 |
| WO | 2006/023014 | 4/2009 |
| WO | 2007/022873 | 5/2009 |

GASEOUS AND LIQUID AGENT FIRE SUPPRESSION SYSTEM USING EMITTERS WITH CLOSED END CAVITY DEFLECTOR

CROSS-REFERENCE TO RELATED APPLICATION

This application is a continuation of U.S. patent application Ser. No. 11/930,526, filed Oct. 31, 2007, now U.S. Pat. No. 7,686,093, which is based on and claims priority to U.S. Provisional Application No. 60/864,480, filed Nov. 6, 2006.

FIELD OF THE INVENTION

This invention concerns fire suppression systems using devices for emitting gaseous and liquid agents in a flow stream projected away from the device onto a fire, the flow stream being deflected by a deflector surface having a closed end cavity.

BACKGROUND OF THE INVENTION

Fire control and suppression sprinkler systems generally include a plurality of individual sprinkler heads Which are usually ceiling mounted about the area to be protected. The sprinkler heads are normally maintained in a closed condition and include a thermally responsive sensing member to determine when a fire condition has occurred. Upon actuation of the thermally responsive member, the sprinkler head is opened, permitting pressurized water at each of the individual sprinkler heads to freely flow therethrough for extinguishing the fire. The individual sprinkler heads are spaced apart from each other by distances determined by the type of protection they are intended to provide (e.g., light or ordinary hazard conditions) and the ratings of the individual sprinklers, as determined by industry accepted rating agencies such as Underwriters Laboratories, Inc., Factory Mutual Research Corp. and/or the National Fire Protection Association.

In order to minimize the delay between thermal actuation and proper dispensing of water by the sprinkler head, the piping that connects the sprinkler heads to the water source is, in many instances, at all times filled with water. This is known as a wet system, with the water being immediately available at the sprinkler head upon its thermal actuation. However, there are many situations in which the sprinkler system is installed in an unheated area, such as warehouses. In those situations, if a wet system is used, and in particular, since the water is not flowing within the piping system over long periods of time, there is a danger of the water within the pipes freezing. This will not only adversely affect the operation of the sprinkler system should the sprinkler heads be thermally actuated while there may be ice blockage within the pipes but, such freezing, if extensive, can result in the bursting of the pipes, thereby destroying the sprinkler system. Accordingly, in those situations, it is the conventional practice to have the piping devoid of any water during its non-activated condition. This is known as a dry fire protection system.

When actuated, traditional sprinkler heads release a spray of fire suppressing liquid, such as water, onto the area of the fire. The water spray, while somewhat effective, has several disadvantages. The water spray exhibits limited modes of fire suppression. For example, the spray, being composed of relatively large droplets providing a small total surface area, does not efficiently absorb heat and therefore cannot operate efficiently to prevent spread of the fire by lowering the temperature of the ambient air around the fire. Large droplets also do not block radiative heat transfer effectively, thereby allowing the fire to spread by this mode. The spray furthermore does not efficiently displace oxygen from the ambient air around the fire, nor is there usually sufficient downward momentum of the droplets to overcome the smoke plume and attack the base of the fire. Additionally, sprinklers which spray large water droplets are not appropriate for use in environments where water damage is a concern. Such environments include museums, which display priceless art objects and antiquities, computer rooms housing servers in a temperature and humidity controlled environment, and regions where high voltage electrical equipment, such as electrical power gear switching boxes, is present.

With these disadvantages in mind, devices, such as resonance tubes, which atomize a fire suppressing liquid, have been considered as replacements for traditional sprinkler heads. Resonance tubes use acoustic energy, generated by an oscillatory pressure wave interaction between a gas jet and a cavity, to atomize a liquid that is injected into the region near the resonance tube where the acoustic energy is present.

Unfortunately, resonance tubes of known design and operational mode generally do not have the fluid flow characteristics required to be effective in fire protection applications.

The volume of flow from the resonance tube tends to be inadequate, and the water particles generated by the atomization process have relatively low velocities. As a result, these water particles are decelerated significantly within about 8 to 16 inches of the sprinkler head and cannot overcome the plume of rising combustion gas generated by a fire. Thus, the water particles cannot get to the fire source for effective fire suppression. Furthermore, the water particle size generated by the atomization is ineffective at reducing the oxygen content to suppress a fire if the ambient temperature is below 55° C. Additionally, known resonance tubes require relatively large gas volumes delivered at high pressure. This produces unstable gas flow which generates significant acoustic energy and separates from deflector surfaces across which it travels, leading to inefficient atomization of the water.

Systems which use only an inert gas to extinguish a fire also suffer certain disadvantages, the primary disadvantage being the reduction in oxygen concentration necessary to extinguish a fire. For example, a gaseous system that uses pure nitrogen will not extinguish flames until the oxygen content at the fire is 12% or lower. This concentration is significantly less than the known breathable limit of 15%. Persons without breathing apparatus exposed to an oxygen concentration of 12% have less than 5 minutes before they lose consciousness for lack of oxygen. At oxygen concentrations of 10% the exposure limit is about one minute. Thus, such systems present a hazard to persons trying to escape or fight the fire.

There is clearly a need for a fire suppression system having an atomizing emitter that can simultaneously discharge both liquid and gaseous extinguishing agents but not suffer the disadvantages of a resonance tube.

SUMMARY OF THE INVENTION

The invention concerns a fire suppression system comprising a gaseous extinguishing agent and a liquid extinguishing agent. At least one emitter is used to atomize and entrain the liquid extinguishing agent in the gaseous extinguishing agent and discharge the gaseous and liquid extinguishing agents on a fire. A gas conduit conducts the gaseous extinguishing agent to the emitter and a piping network conducts the liquid extinguishing agent to the emitter. A first valve in the gas conduit controls pressure and flow rate of the gaseous extinguishing agent to the emitter. A second valve in the piping network controls pressure and flow rate of the liquid extinguishing agent to the emitter. A pressure transducer measures pressure within the gas conduit. A fire detection device is positioned proximate to the emitter.

The emitter comprises a nozzle having an inlet and an outlet and an unobstructed bore therebetween. The outlet has a diameter, and the inlet is connected with the gas conduit downstream of the first valve. A duct is connected in fluid communication with the piping network downstream of the second valve. The duct has an exit orifice positioned adjacent to the nozzle outlet. A deflector surface is positioned facing the nozzle outlet in spaced relation thereto. The deflector surface has a first surface portion comprising a flat surface oriented substantially perpendicularly to a gas flow from the nozzle, and a second surface portion comprising an angled surface, or alternately, a curved surface, surrounding the flat surface. The flat surface has a minimum diameter approximately equal to the outlet diameter. A closed end cavity is positioned within the deflector surface and is surrounded by the flat surface.

A control system is in communication with the first and second valves, the pressure transducer and the fire detection device. The control system receives signals from the pressure transducer and the fire detection device and opens the valves in response to a signal indicative of a fire from the fire detection device.

The gaseous extinguishing agent may be supplied to the inlet at a pressure between about 29 psia and about 60 psia inclusive, and the liquid extinguishing agent may be supplied to the duct at a pressure between about 1 psig and about 50 psig inclusive.

The gaseous extinguishing agent may be air, nitrogen, mixtures of inert gases including argon, nitrogen and carbon dioxide, synthetic compounds including fluoroform, 1,1,1,2,2-pentafluoroethane, 1,1,1,2,3,3,3-heptafluoropropane or combinations thereof, and the liquid extinguishing agent may be water, de-ionized water, heptafluoropropane, bromochlorodifluoromethane, bromotrifluoromethane or combinations thereof.

The deflector surface is positioned so that the gaseous extinguishing agent forms a first shock front between the outlet and the deflector surface, and a second shock front proximate to the deflector surface.

The liquid extinguishing agent may be entrained with the gaseous extinguishing agent proximate to the first shock front or the second shock front.

The emitter may comprise a plurality of ducts, each having a respective exit orifice positioned adjacent to the nozzle outlet. In one embodiment, the ducts are angularly oriented toward the nozzle.

The system may further comprise a plurality of emitters distributed over a plurality of fire hazard zones and a plurality of compressed gas tanks comprising a source of pressurized gaseous extinguishing agent. A high pressure manifold provides fluid communication between the compressed gas tanks and the gas conduit upstream of the first valve.

The system may also comprise a plurality of emitters distributed over a plurality of fire hazard zones and a single compressed gas tank comprising a source of pressurized gaseous extinguishing agent for all of the emitters in all of the fire hazard zones.

DETAILED DESCRIPTION OF THE EMBODIMENTS

Figure 1:
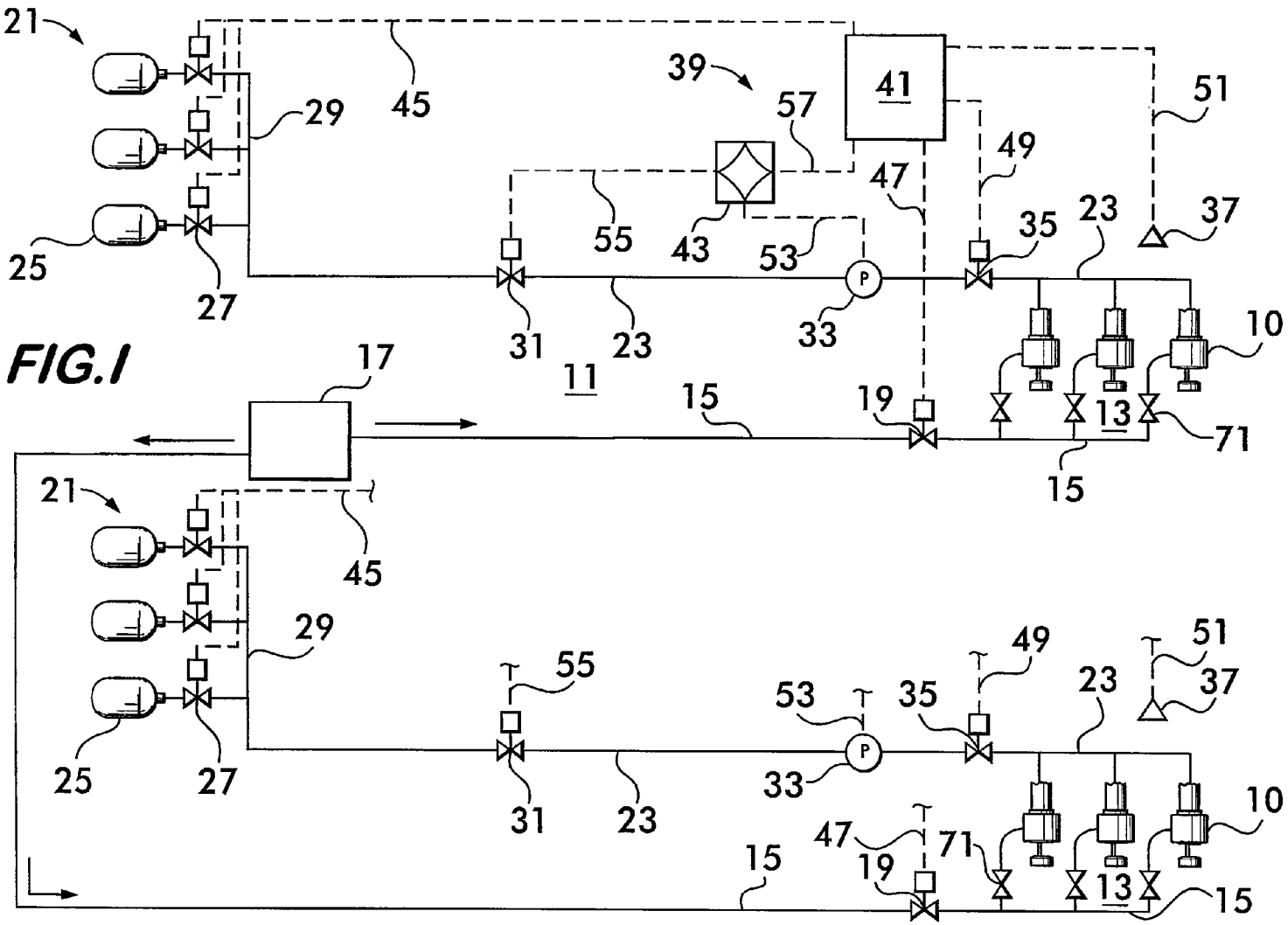
FIGS. 1 and 1A are schematic diagrams illustrating exemplary embodiments of dual extinguishment fire suppression systems according to the invention.

FIG. 1 illustrates, in schematic form, an example dual extinguishment fire suppression system 11 according to the invention. System 11 includes a plurality of high velocity low pressure emitters 10, described in detail below. Emitters 10 are arranged in a potential fire hazard zone 13, the system comprising one or more such zones, each zone having its own bank of emitters. For clarity, only one zone is described herein, it being understood that the description is applicable to additional fire hazard zones as shown.

The emitters 10 are connected via a piping network 15 to a source of pressurized liquid extinguishing agent 17. Examples of practical liquid agents include synthetic compounds such as heptafluoropropane (sold under the tradename Novec™ 1230), bromochlorodifluoromethane and bromotrifluoromethane. Water is also feasible, and especially de-ionized water for use near charged electrical equipment. De-ionized water reduces electrical arcing due to its low conductivity.

It is preferred to control the flow of liquid to each emitter 10 using individual flow control devices 71 positioned immediately upstream of each emitter. Preferably the individual control devices include a flow cartridge and a strainer to protect the flow cartridge and the emitter. The flow cartridge operates autonomously to provide a constant flow rate over a known pressure range and is useful to compensate for variations in water pressure at the source as well as frictional head loss due to long pipe runs and intervening joints such as elbows. Proper operation of the emitters, described below, is ensured by controlling the flow at each emitter. A liquid control valve 19 may be used to control the flow of liquid from the source 17 to the emitters 10, with fine control of the flow rate managed by the individual flow control devices 71.

Figure 1A:
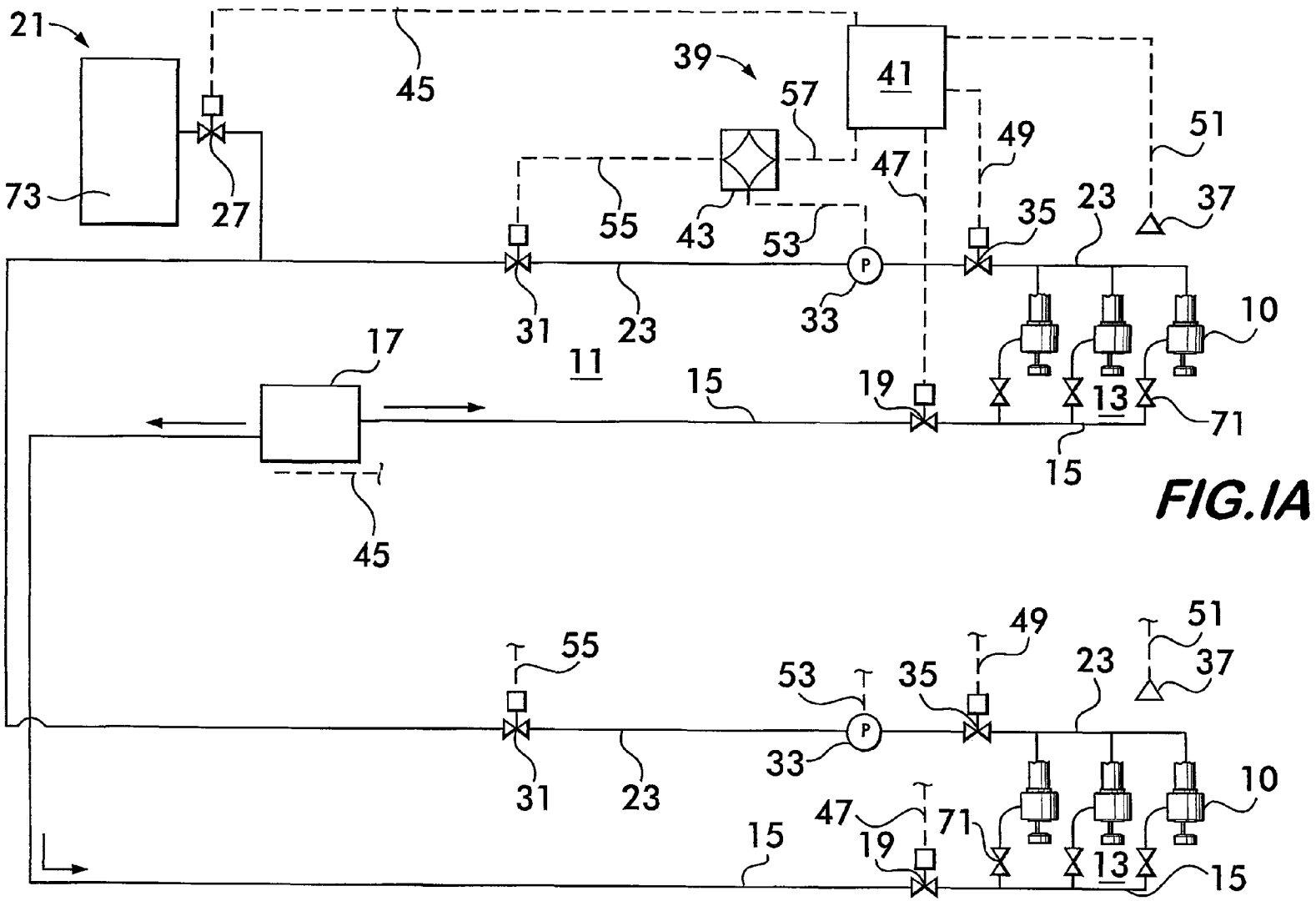

The emitters are also in fluid communication with a source of pressurized gaseous extinguishing agent 21 through a gas conduit network 23. Candidate gaseous extinguishing agents include mixtures of atmospheric gases such as Inergen™ (52% nitrogen, 40% argon, 8% carbon dioxide) and Argonite™ (50% argon and 50% nitrogen) as well as synthetic compounds such as fluoroform, 1,1,1,2,2-pentafluoroethane and 1,1,1,2,3,3,3-heptafluoropropane. The gaseous extinguishing agent may be maintained in banks of high-pressure cylinders 25 as shown in FIG. 1. Cylinders 25 may be pressurized up to 2,500 psig. For large systems which require large volumes of gas, one or more lower pressure tanks (about 350 psig) having volumes on the order of 30,000 gallons may be used. Alternately, large volume high pressure tanks (for example 30 cubic feet at a pressure of 2600 psi) may also be used. In a further practical embodiment, shown in FIG. 1A, the gaseous extinguishing agent may be stored in a single tank 73 common to all emitters 10 in all of the fire hazard zones 13.

Valves 27 of cylinders 25 (or tank 73) are preferably maintained in an open state in communication with a high pressure manifold 29. Gas flow rate and pressure from the manifold to the gas conduit 23 are controlled by a high pressure gas control valve 31. Pressure in the conduit 23 downstream of the high pressure control valve 31 is measured by a pressure transducer 33. Flow of gas to the emitters 10 in each fire hazard zone 13 is further controlled by a low pressure valve 35 downstream of the pressure transducer.

Each fire hazard zone 13 is monitored by one or more fire detection devices 37. These detection devices operate in any of the various known modes for fire detection, such as sensing of flame, heat, rate of temperature rise, smoke detection or combinations thereof.

The system components thus described are coordinated and controlled by a control system 39, which comprises, for example, a microprocessor 41 having a control panel display (not shown), resident software, and a programmable logic controller 43. The control system communicates with the system components to receive information and issue control commands as follows.

Each cylinder valve 27 is monitored as to its status (open or closed) by a supervisory loop 45 that communicates with the microprocessor 41, which provides a visual indication of the cylinder valve status. Liquid control valve 19 is also in communication with microprocessor 41 via a communication line 47, which allows the valve 19 to be monitored and controlled (opened and closed) by the control system. Similarly, gas control valve 35 communicates with the control system via a communication line 49, and the fire detection devices 37 also communicate with the control system via communication lines 51. The pressure transducer 33 provides its signals to the programmable logic controller 43 over communication line 53. The programmable logic controller is also in communication with the high pressure gas valve 31 over communication line 55, and with the microprocessor 41 over communication line 57.

In operation, fire detectors 37 sense a fire event and provide a signal to the microprocessor 41 over communication line 51. The microprocessor actuates the logic controller 43. Note that controller 43 may be a separate controller or an integral part of the high pressure control valve 31. The logic controller 43 receives a signal from the pressure transducer 33 via communication line 53 indicative of the pressure in the gas conduit 23. The logic controller 43 opens the high pressure gas valve 31 while the microprocessor 41 opens the gas control valve 35 and the liquid control valve 19 using respective communication lines 49 and 47. Gaseous extinguishing agent from tanks 25 and liquid extinguishing agent from source 17, are thus permitted to flow through gas conduit 23 and liquid piping network 15 respectively. Preferred liquid extinguishing agent pressure for proper operation of the emitters 10 is between about 1 psig and about 50 psig as described below. The flow cartridges or other such flow control devices 71 maintain the required liquid flow rate. The logic controller 43 operates valve 31 to maintain the correct pressure of gaseous extinguishing agent (between about 29 psia and about 60 psia inclusive) and flow rate to operate the emitters 10 within the parameters as described below. For a ½ inch emitter tests show nitrogen supplied at pressure of 25 psi and a flow rate of 150 scfm is effective.

The dual extinguishing agents discharged by the emitters 10 work together to extinguish the fire in the presence of an oxygen concentration of no lower than 15%. This is significantly better than various gas only systems such as those which use nitrogen and require a reduction of oxygen concentration of 12% or lower before the fire will be extinguished. It is advantageous to maintain an oxygen concentration of at least 15% if possible, as 15% is a known safe level and provides a breathable atmosphere. In action, the gaseous extinguishing agent reduces the fire plume temperature to the critical adiabatic temperature of the fire. (This is the temperature at which the fire will self-extinguish.) In addition to lowering the fire plume temperature, the gaseous component acts to decreases the oxygen concentration as well. The liquid extinguishing agent acts as a heat sink to absorb heat from the fire and thereby suppress it.

Upon sensing that the fire is extinguished, the microprocessor 41 closes the gas and liquid valves 35 and 19, and the logic controller 43 closes the high pressure control valve 31. The control system 39 continues to monitor all the fire hazard zones 13, and in the event of another fire or the re-flashing of the initial fire the above described sequence is repeated.

Figure 2:
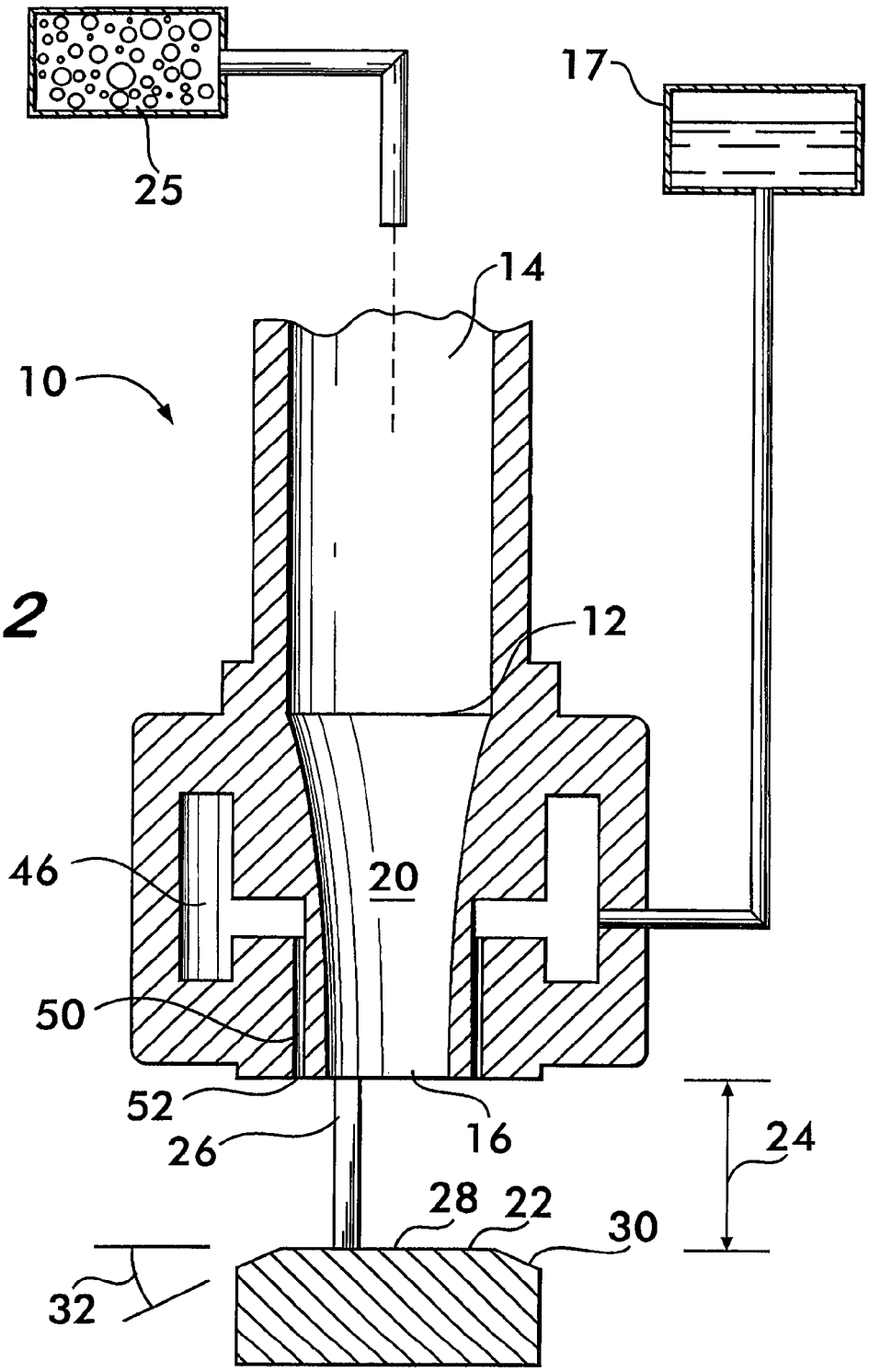
FIG. 2 is a longitudinal sectional view of a high velocity low pressure emitter used in the fire suppression system shown in FIG. 1.

FIG. 2 shows a longitudinal sectional view of a high velocity low pressure emitter 10 according to the invention. Emitter 10 comprises a convergent nozzle 12 having an inlet 14, an outlet 16 and an unobstructed bore therebetween. Outlet 16 may range in diameter between about ⅛ inch to about 1 inch for many applications. Inlet 14 is in fluid communication with a pressurized supply of gaseous extinguishing agent, for example, the cylinders 25 (see also FIG. 1), that provides the gaseous extinguishing agent to the nozzle at a predetermined pressure and flow rate. It is advantageous that the nozzle 12 have a curved convergent inner surface 20, although other shapes, such as a linear tapered surface, are also feasible.

A deflector surface 22 is positioned in spaced apart relation with the nozzle 12, a gap 24 being established between the deflector surface and the nozzle outlet. The gap may range in size between about 1/10 inches to about ¾ inches. The deflector surface 22 is held in spaced relation from the nozzle by one or more support legs 26.

Preferably, deflector surface 22 comprises a flat surface portion 28 substantially aligned with the nozzle outlet 16, and an angled surface portion 30 contiguous with and surrounding the flat portion. Flat portion 28 is substantially perpendicular to the gas flow from nozzle 12, and has a minimum diameter approximately equal to the diameter of the outlet 16. The angled portion 30 is oriented at a sweep back angle 32 from the flat portion. The sweep back angle may range between about 15° and about 45° and, along with the size of gap 24, determines the dispersion pattern of the flow from the emitter.

Figure 3:
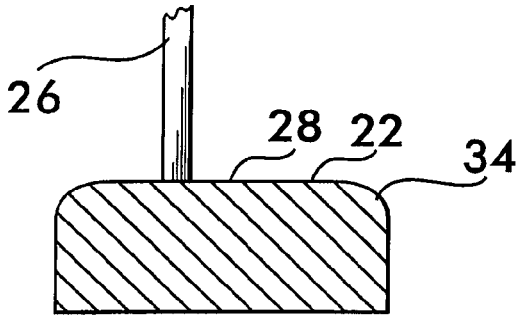
FIG. 3 is a longitudinal sectional view showing a component of the emitter depicted in FIG. 2.
Figure 4:
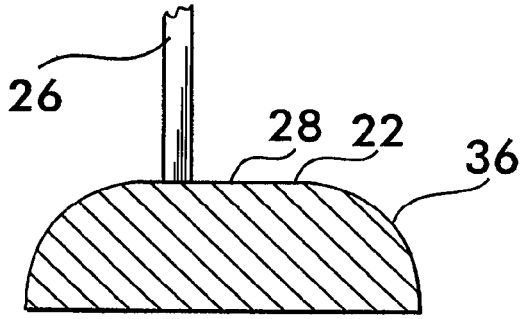
FIG. 4 is a longitudinal sectional view showing a component of the emitter depicted in FIG. 2.
Figure 5:
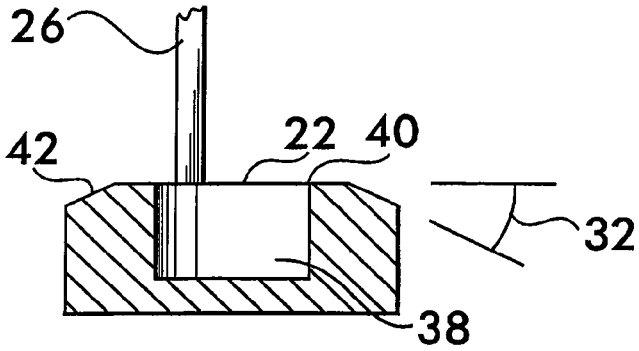
FIG. 5 is a longitudinal sectional view showing a component of the emitter depicted in FIG. 2.
Figure 6:
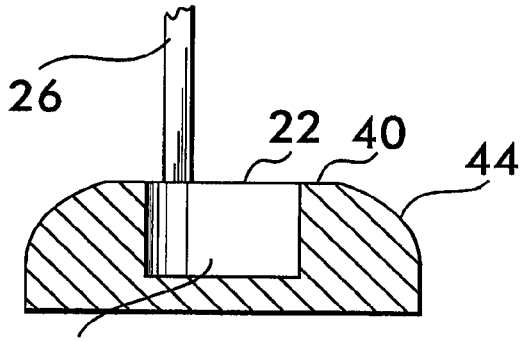
FIG. 6 is a longitudinal sectional view showing a component of the emitter depicted in FIG. 2.

Deflector surface 22 may have other shapes, such as the curved upper edge 34 shown in FIG. 3 and the curved edge 36 shown in FIG. 4. As shown in FIGS. 5 and 6, the deflector surface 22 may also include a closed end cavity 38 surrounded by a flat portion 40. A swept back, angled portion 42 (FIG. 5) may surround the flat portion 40, or a curved portion 44 (FIG. 6) may surround the flat portion. The depth of the cavity may be approximately equal to the diameter of outlet 16.

With reference again to FIG. 2, an annular chamber 46 surrounds nozzle 12. Chamber 46 is in fluid communication with a pressurized liquid supply, for example, the liquid extinguishing agent source 17 of FIG. 1 that provides the liquid extinguishing agent to the chamber at a predetermined pressure and flow rate. A plurality of ducts 50 extend from the chamber 46. Each duct has an exit orifice 52 positioned adjacent to nozzle outlet 16. The exit orifices have a diameter of about 1/32 inch to about ⅛ inch. Preferred distances between the nozzle outlet 16 and the exit orifices 52 range between about 1/64 inch to about 1/8 inch as measured along a radius line from the edge of the nozzle outlet to the closest edge of the exit orifice. Liquid extinguishing agent flows from the pressurized supply 17 into the chamber 46 and through the ducts 50, exiting from each orifice 52 where it is atomized by the flow of gaseous extinguishing agent from the pressurized gas supply that flows through the nozzle 12 and exits through the nozzle outlet 16 as described in detail below.

Emitter 10, when configured for use in a fire suppression system, is designed to operate with a gas pressure between about 29 psia to about 60 psia (inclusive) at the nozzle inlet 14 and a liquid extinguishing agent pressure between about 1 psig and about 50 psig (inclusive) in chamber 46.

Figure 7:
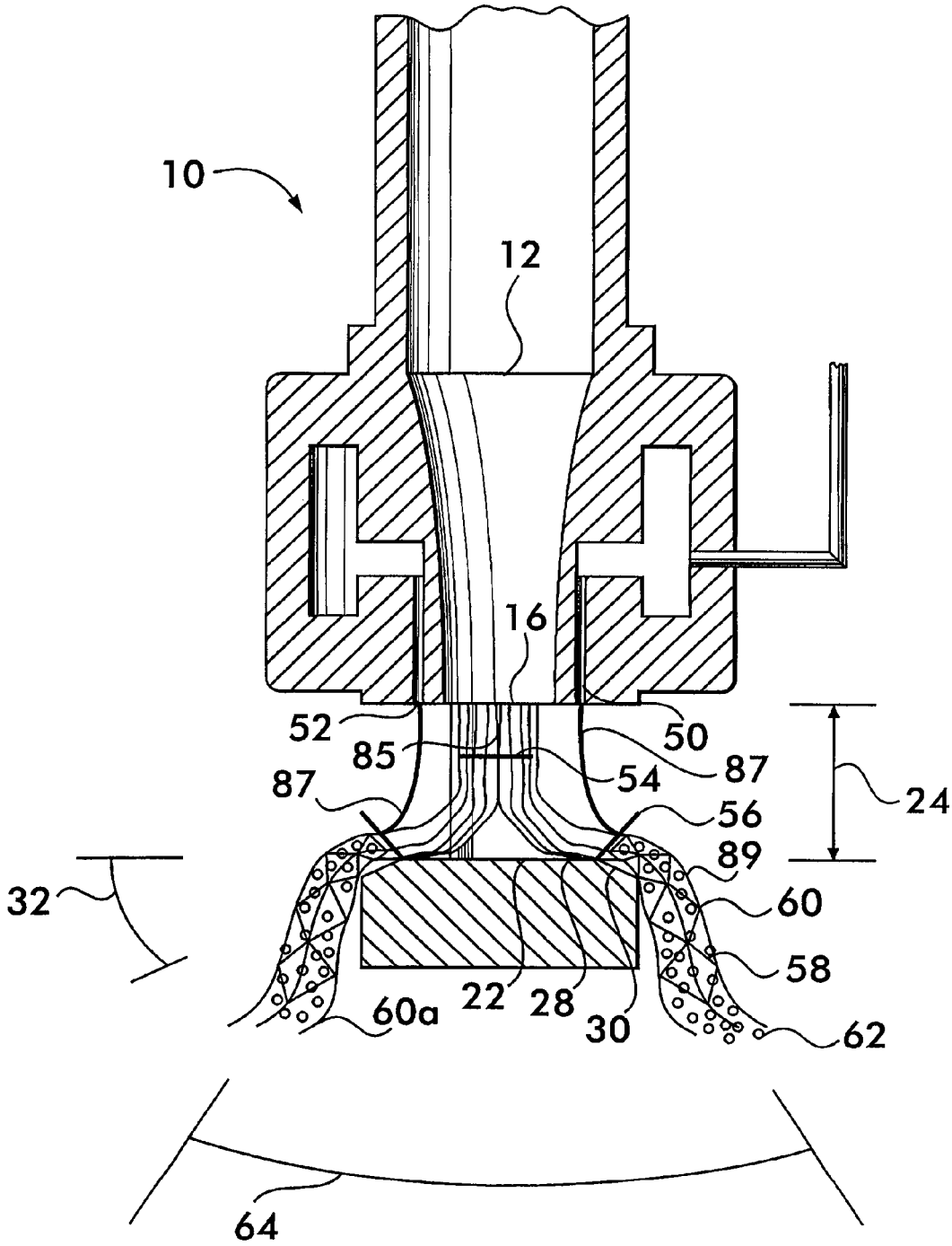
FIG. 7 is a diagram depicting fluid flow from the emitter based upon a Schlieren photograph of the emitter shown in FIG. 2 in operation.

Operation of the emitter 10 is described with reference to FIG. 7 which is a drawing based upon Schlieren photographic analysis of an operating emitter.

Gaseous extinguishing agent 85 exits the nozzle outlet 16 at about Mach 1 and impinges on the deflector surface 22. Simultaneously, liquid extinguishing agent 87 is discharged from exit orifices 52.

Interaction between the gaseous extinguishing agent 85 and the deflector surface 22 establishes a first shock front 54 between the nozzle outlet 16 and the deflector surface 22. A shock front is a region of flow transition from supersonic to subsonic velocity. Liquid extinguishing agent 87 exiting the orifices 52 does not enter the region of the first shock front 54 in this mode of operation of the emitter.

A second shock front 56 forms proximate to the deflector surface at the border between the flat surface portion 28 and the angled surface portion 30. Liquid extinguishing agent 87 discharged from the orifices 52 is entrained with the gaseous extinguishing agent 85 proximate to the second shock front 56 forming a liquid-gas stream 60. One method of entrainment is to use the pressure differential between the pressure in the gas flow jet and the ambient. Shock diamonds 58 form in a region along the angled portion 30, the shock diamonds being confined within the liquid-gas stream 60, which projects outwardly and downwardly from the emitter. The shock diamonds are also transition regions between super and subsonic flow velocity and are the result of the gas flow being overexpanded as it exits the nozzle. Overexpanded flow describes a flow regime wherein the external pressure (i.e., the ambient atmospheric pressure in this case) is higher than the gas exit pressure at the nozzle. This produces oblique shock waves which reflect from the free jet boundary 89 marking the limit between the liquid-gas stream 60 and the ambient atmosphere. The oblique shock waves are reflected toward one another to create the shock diamonds.

Significant shear forces are produced in the liquid-gas stream 60, which ideally does not separate from the deflector surface, although the emitter is still effective if separation occurs as shown at 60*a*. The liquid extinguishing agent entrained proximate to the second shock front 56 is subjected to these shear forces which are the primary mechanism for atomization. The liquid extinguishing agent also encounters the shock diamonds 58, which are a secondary source of atomization.

Thus, the emitter 10 operates with multiple mechanisms of atomization which produce liquid particles 62 less than 20 μm in diameter, the majority of the particles being measured at less than 10 μm. The smaller droplets are buoyant in air. This characteristic allows them to maintain proximity to the fire source for greater fire suppression effect. Furthermore, the particles maintain significant downward momentum, allowing the liquid-gas stream 60 to overcome the rising plume of combustion gases resulting from a fire. Measurements show the liquid-gas stream having a velocity of about 7,000 ft/min 18 inches from the emitter, and a velocity greater than 1,700 ft/min 8 feet from the emitter. The flow from the emitter is observed to impinge on the floor of the room in which it is operated. The sweep back angle 32 of the angled portion 30 of the deflector surface 22 provides significant control over the included angle 64 of the liquid-gas stream 60. Included angles of about 120° are achievable. Additional control over the dispersion pattern of the flow is accomplished by adjusting the gap 24 between the nozzle outlet 16 and the deflector surface.

During emitter operation it is further observed that the smoke layer that accumulates at the ceiling of a room during a fire is drawn into the stream of gaseous extinguishing agent 85 exiting the nozzle and is entrained in the flow 60. This adds to the multiple modes of extinguishment characteristic of the emitter as described below.

The emitter causes a temperature drop due to the atomization of the liquid extinguishing agent into the extremely small particle sizes described above. This absorbs heat and helps mitigate spread of combustion. The flow of liquid extinguishing agent entrained in the flow of gaseous extinguishing agent replace the oxygen in the room with gases that cannot support combustion. Further oxygen depleted gases in the form of the smoke layer that is entrained in the flow also contributes to the oxygen starvation of the fire. It is observed, however, that the oxygen level in the room where the emitter is deployed does not drop below about 15%. The liquid extinguishing agent particles and the entrained smoke create a fog that blocks radiative heat transfer from the fire, thus, mitigating spread of combustion by this mode of heat transfer. The mixing and the turbulence created by the emitter also helps lower the temperature in the region around the fire.

The emitter is unlike resonance tubes in that it does not produce significant acoustic energy. Jet noise (the sound generated by air moving over an object) is the only acoustic output from the emitter. The emitter's jet noise has no significant frequency components higher than about 6 kHz (half the operating frequency of well known types of resonance tubes) and does not contribute significantly to atomization.

Furthermore, the flow from the emitter is stable and does not separate from the deflector surface (or experiences delayed separation as shown at 60*a*) unlike the flow from resonance tubes, which is unstable and separates from the deflector surface, thus leading to inefficient atomization or even loss of atomization.

Figure 8:
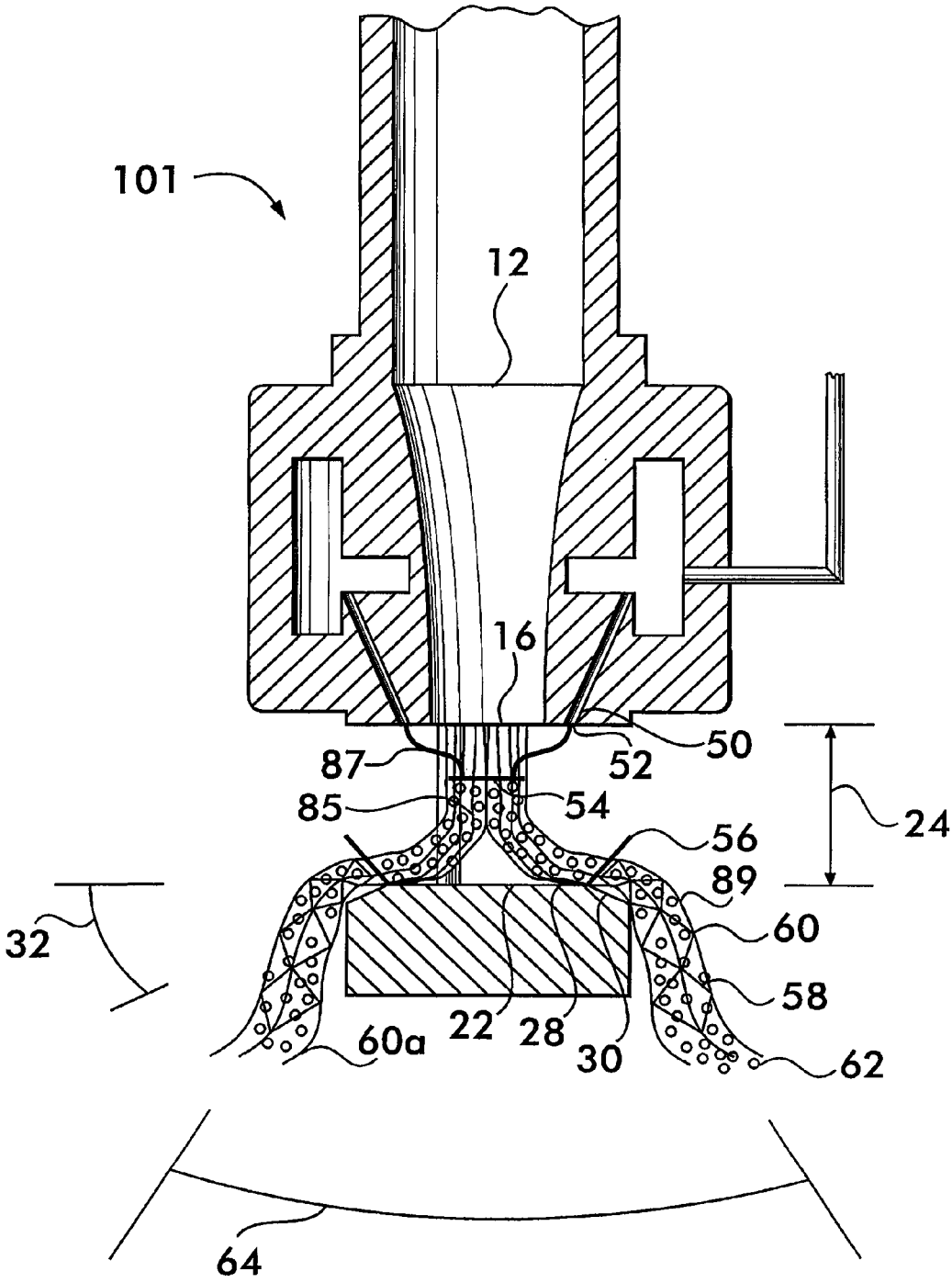
FIG. 8 is a diagram depicting predicted fluid flow for another embodiment of the emitter.

Another emitter embodiment 101 is shown in FIG. 8. Emitter 101 has ducts 50 that are angularly oriented toward the nozzle 12. The ducts are angularly oriented to direct the liquid extinguishing agent 87 toward the gaseous extinguishing agent 85 so as to entrain the liquid in the gas proximate to the first shock front 54. It is believed that this arrangement will add yet another region of atomization in the creation of the liquid-gas stream 60 projected from the emitter 11.

What is claimed is:

1. A fire suppression system, comprising:

a gaseous extinguishing agent;

a liquid extinguishing agent;

at least one emitter for atomizing and entraining said liquid extinguishing agent in said gaseous extinguishing agent and discharging said gaseous and liquid extinguishing agents on a fire;

a gas conduit conducting said gaseous extinguishing agent to said emitter;

a piping network conducting said liquid extinguishing agent to said emitter;

a first valve in said gas conduit controlling pressure and flow rate of said gaseous extinguishing agent to said emitter;

a second valve in said piping network controlling pressure and flow rate of said liquid extinguishing agent to said emitter;

a pressure transducer measuring pressure within said gas conduit;

a fire detection device positioned proximate to said emitter, said emitter comprising:

a nozzle having an inlet and an outlet and an unobstructed bore therebetween, said outlet having a diameter, said inlet connected with said gas conduit downstream of said first valve;

a duct connected in fluid communication with said piping network downstream of said second valve, said duct having an exit orifice positioned adjacent to said nozzle outlet;

a deflector surface positioned facing said nozzle outlet in spaced relation thereto and having a first surface portion comprising a flat surface oriented substantially perpendicularly to a gas flow from said nozzle, and a second surface portion comprising an angled surface surrounding said flat surface, said flat surface having a minimum diameter approximately equal to said outlet diameter;

a closed end cavity positioned within said deflector surface and surrounded by said flat surface; and a control system in communication with said first and second valves, said pressure transducer and said fire detection device, said control system receiving signals from said pressure transducer and said fire detection device and opening said valves in response to a signal indicative of a fire from said fire detection device.

2. The system according to claim 1, further comprising:

a plurality of said emitters distributed over a plurality of fire hazard zones;

a plurality of compressed gas tanks comprising a source of pressurized gaseous extinguishing agent; and a high pressure manifold providing fluid communication between said compressed gas tanks and said gas conduit upstream of said first valve.

3. The system according to claim 1, further comprising:

a plurality of said emitters distributed over a plurality of fire hazard zones; and a single compressed gas tank comprising a source of pressurized gaseous extinguishing agent for all of said emitters in all of said fire hazard zones.

4. The system according to claim 1, further comprising a flow control device positioned in said piping network between said emitter and said second valve.

5. The system according to claim 4, wherein said flow control device comprises a flow cartridge.

6. The system according to claim 1, further comprising:

a plurality of said emitters distributed over a plurality of fire hazard zones; and a plurality of flow control devices positioned in said piping network between each one of said emitters and said second valve.

7. The system according to claim 6, wherein said flow control devices each comprise a flow cartridge.

8. The system according to claim 1, wherein said gaseous extinguishing agent has a pressure between about 29 psia and about 60 psia in said gas conduit.

9. The system according to claim 1, wherein said liquid extinguishing agent has a pressure between about 1 psig and about 50 psig in said piping network.

10. The system according to claim 1, wherein said deflector surface is positioned so that said gaseous extinguishing agent forms a first shock front between said outlet and said deflector surface, and a second shock front is formed proximate to said deflector surface.

11. The system according to claim 10, wherein said liquid extinguishing agent is entrained with said gaseous extinguishing agent proximate to said first shock front.

12. The system according to claim 10, wherein said liquid extinguishing agent is entrained with said gaseous extinguishing agent proximate to said second shock front.

13. The system according to claim 1, further comprising a plurality of said ducts, each of said ducts having a respective exit orifice positioned adjacent to said nozzle outlet.

14. The system according to claim 13, wherein said ducts are angularly oriented toward said nozzle.

15. A fire suppression system, comprising:

a gaseous extinguishing agent;

a liquid extinguishing agent;

at least one emitter for atomizing and entraining said liquid extinguishing agent in said gaseous extinguishing agent and discharging said gaseous and liquid extinguishing agents on a fire;

a gas conduit conducting said gaseous extinguishing agent to said emitter;

a piping network conducting said liquid extinguishing agent to said emitter;

a first valve in said gas conduit controlling pressure and flow rate of said gaseous extinguishing agent to said emitter;

a second valve in said piping network controlling pressure and flow rate of said liquid extinguishing agent to said emitter;

a pressure transducer measuring pressure within said gas conduit;

a fire detection device positioned proximate to said emitter, said emitter comprising:

a nozzle having an inlet and an outlet and an unobstructed bore therebetween, said outlet having a diameter, said inlet being connected in fluid communication with said gas conduit downstream of said first valve;

a duct connected in fluid communication with said piping network downstream of said second valve, said duct having an exit orifice positioned adjacent to said nozzle outlet;

a deflector surface positioned facing said nozzle outlet in spaced relation thereto and having a first surface portion comprising a flat surface oriented substantially perpendicularly to a gas flow from said nozzle, and a second surface portion comprising a curved surface surrounding said flat surface, said flat surface having minimum diameter approximately equal to said outlet diameter;

a closed end cavity positioned within said deflector surface and surrounded by said flat surface; and a control system in communication with said first and second valves, said pressure transducer and said fire detection device, said control system receiving signals from said pressure transducer and said fire detection device and opening said valves in response to a signal indicative of a fire from said fire detection device.

16. The system according to claim 15, further comprising:

a plurality of said emitters distributed over a plurality of fire hazard zones;

a plurality of compressed gas tanks comprising a source of pressurized gaseous extinguishing agent; and a high pressure manifold providing fluid communication between said compressed gas tanks and said gas conduit upstream of said first valve.

17. The system according to claim 15, further comprising:

a plurality of said emitters distributed over a plurality of fire hazard zones; and a single compressed gas tank comprising a source of pressurized gaseous extinguishing agent for all of said emitters in all of said fire hazard zones.

18. The system according to claim 15, further comprising a flow control device positioned in said piping network between said emitter and said second valve.

19. The system according to claim 18, wherein said flow control device comprises a flow cartridge.

20. The system according to claim 15, further comprising:

a plurality of said emitters distributed over a plurality of fire hazard zones; and a plurality of flow control devices positioned in said piping network between each one of said emitters and said second valve.

21. The system according to claim 20, wherein said flow control devices each comprise a flow cartridge.

22. The system according to claim 15, wherein said gaseous extinguishing agent has a pressure between about 29 psia and about 60 psia in said gas conduit.

23. The system according to claim 15, wherein said liquid extinguishing agent has a pressure between about 1 psig and about 50 psig in said piping network.

24. The system according to claim 15, wherein said deflector surface is positioned so that said gaseous extinguishing agent forms a first shock front between said outlet and said deflector surface, and a second shock front is formed proximate to said deflector surface.

25. The system according to claim 24, wherein said liquid extinguishing agent is entrained with said gaseous extinguishing agent proximate to said first shock front.

26. The system according to claim 24, wherein said liquid extinguishing agent is entrained with said gaseous extinguishing agent proximate to said second shock front.

27. The system according to claim 15, further comprising a plurality of said ducts, each of said ducts having a respective exit orifice positioned adjacent to said nozzle outlet.

28. The system according to claim 27, wherein said ducts are angularly oriented toward said nozzle.

* * * * *